US010695595B2

(12) United States Patent
Grant

(10) Patent No.: US 10,695,595 B2
(45) Date of Patent: Jun. 30, 2020

(54) SAFETY LINE SHOCK ABSORBER

(71) Applicant: Engineered Supply L.L.C., Bayport, MN (US)

(72) Inventor: Arlen Paul Grant, Stillwater, MN (US)

(73) Assignee: Engineered Supply L.L.C., Bayport, MN (US)

( * ) Notice: Subject to any disclaimer, the term of this patent is extended or adjusted under 35 U.S.C. 154(b) by 0 days.

(21) Appl. No.: 16/012,725

(22) Filed: Jun. 19, 2018

(65) Prior Publication Data

US 2019/0143159 A1 May 16, 2019

Related U.S. Application Data

(60) Provisional application No. 62/521,261, filed on Jun. 16, 2017.

(51) Int. Cl.

| | |
|---|---|
| ***A62B 35/04*** | (2006.01) |
| ***A62B 35/00*** | (2006.01) |
| ***E04G 21/32*** | (2006.01) |

(52) U.S. Cl.
CPC ..... *A62B 35/04* (2013.01); *A62B 35/0056* (2013.01); *E04G 21/3204* (2013.01)

(58) Field of Classification Search
CPC . A62B 35/04; A62B 35/0056; E04G 21/3204; Y10T 24/314; Y10T 24/316
See application file for complete search history.

(56) References Cited

U.S. PATENT DOCUMENTS 6,014,794 A * 1/2000 McCoy ..... B62J 7/08 24/265 H
7,454,818 B1 * 11/2008 Backman ..... B60P 7/0823 24/300

* cited by examiner

*Primary Examiner* — Robert Sandy
(74) *Attorney, Agent, or Firm* — Vidas, Arrett & Steinkraus

(57) ABSTRACT

In at least one embodiment, a lifeline includes a wire rope and a shock absorber. In some embodiments, the shock absorber includes a tubular body defining a lumen therethrough. The tubular body defines a longitudinal axis including curvature along its length.

20 Claims, 6 Drawing Sheets

SAFETY LINE SHOCK ABSORBER

CROSS-REFERENCE TO RELATED APPLICATIONS

This application claims the benefit of U.S. Patent Application No. 62/521,261, filed Jun. 16, 2017, the entire content of which is hereby incorporated herein by reference.

BACKGROUND OF THE INVENTION

This invention relates to generally to building safety and fall protection systems, and more specifically to lifelines and lifeline shock absorbers.

Shock absorbers and lifelines are generally known. Shock absorbers are often complicated and expensive. There remains a need for novel shock absorber systems that are simple and economical.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a lifeline comprises a wire rope and a shock absorber. In some embodiments, the shock absorber comprises a tubular body defining a lumen therethrough. The tubular body defines a longitudinal axis comprising curvature along its length. The wire rope extends through the lumen of the shock absorber.

In some embodiments, the shock absorber comprises a first nominal shape and a second deformed shape. In some embodiments, a body of the shock absorber elongates as the shock absorber deforms.

In some embodiments, the shock absorber comprises a U-shape. In some embodiments, a longitudinal axis of a body of the shock absorber forms a U-shape.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
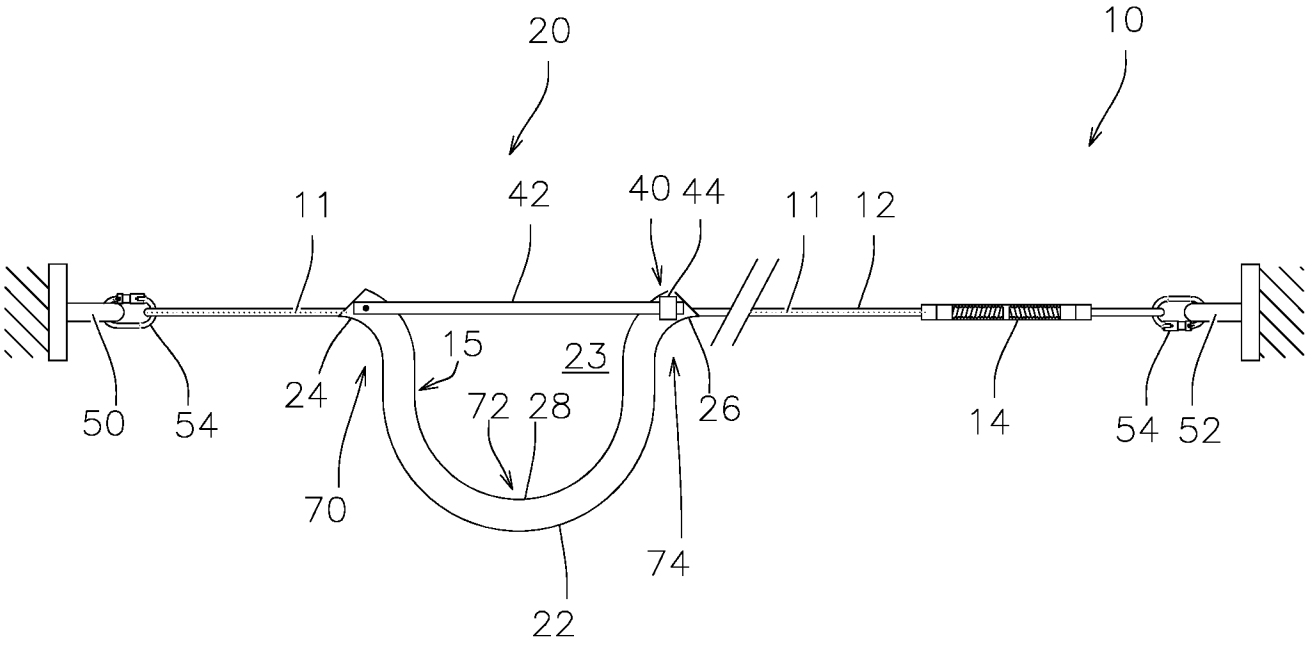
FIG. 1 shows an embodiment of a lifeline comprising an embodiment of a shock absorber.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
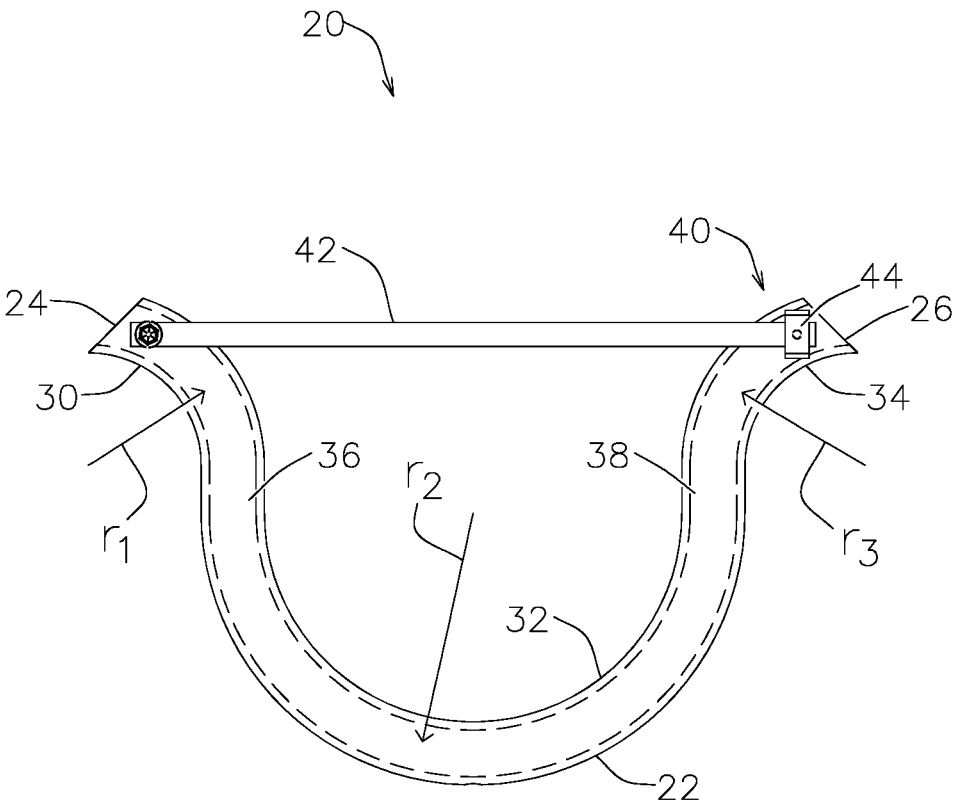
FIG. 2 shows an embodiment of a shock absorber.
Figure 3:
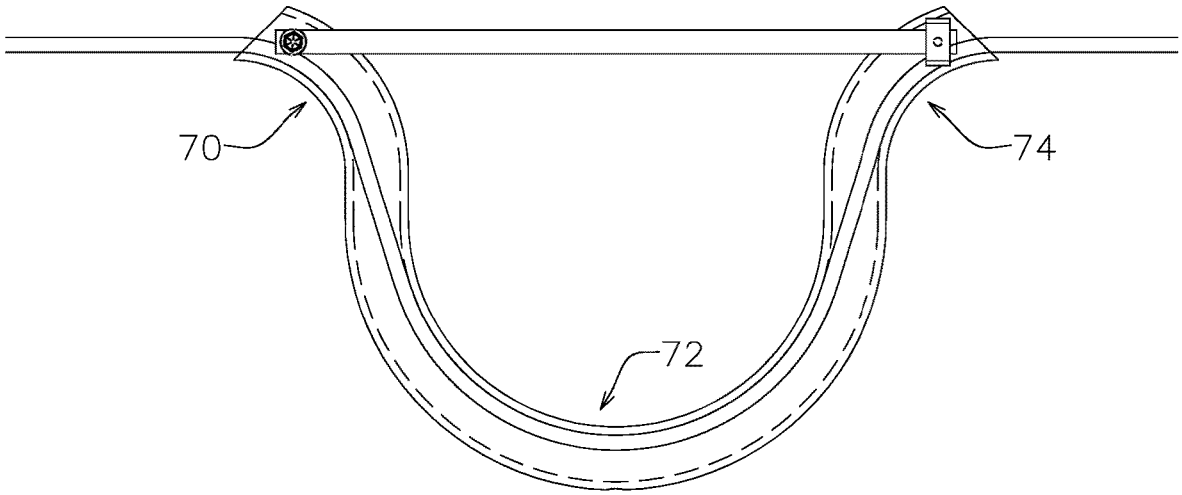
FIG. 3 shows an embodiment of a tension member extending through an embodiment of a shock absorber.

FIG. 1 shows an embodiment of a lifeline 10. In some embodiments, a lifeline 10 comprises tension member 12 and a shock absorber 20. FIG. 2 shows an embodiment of a shock absorber 20. FIG. 3 shows an embodiment of a tension member 12 extending through an embodiment of a shock absorber 20.

Referring to FIGS. 1-3, in some embodiments, a lifeline 10 comprises a tension member 12 arranged to extend between a first anchor 50 and a second anchor 52. Anchors 50, 52 are often provided on tall buildings, and a lifeline 10 can attach to the anchors 50, 52. In some embodiments, a lifeline 10 comprises one or more carabiners 54 arranged to engage the anchors 50, 52.

The tension member 12 can comprise any suitable tension member, such as metal, natural fibers, synthetic fibers, etc., and can comprise any suitable cross-sectional shape. In some embodiments, a tension member 12 comprises a strap. In some embodiments, a tension member 12 comprises a wire rope, for example comprising galvanized metal or stainless steel.

In some embodiments, a lifeline 10 comprises a tensioning device 14 arranged to adjust an amount of tension in the tension member 12. Any suitable tensioning device 14 can be used, such as a turnbuckle, a ratcheting mechanism, come-along, etc.

In some embodiments, a shock absorber 20 comprises a body member 22 comprising a non-linear portion along its length. In some embodiments, the shock absorber 20 engages the tension member 12 and causes the tension member to have a displaced portion 15 that is laterally displaced from a direct line extending between the anchors 50, 52. In some embodiments, the shock absorber 20 is arranged to deform upon a sharp increase in the tension in the tension member 12, for example as caused by the lifeline 10 catching a user during a fall. Desirably, deformation of the shock absorber 20 allows for an effective feed-out of the tension member 12 and reduces the impact and jerk experienced by a user that is caught by the lifeline 10.

In some embodiments, the body member 22 of the shock absorber 20 comprises a tubular shape defining a lumen therethrough. In some embodiments, a sidewall of the body member 22 fully surrounds the lumen. In some embodiments, the tension member 12 extends through the lumen of the body member 22.

In some embodiments, the body member 22 comprises curvature along its length. In some embodiments, the body member 22 comprises an angle, or multiple linear body portions arranged at an angle to one another. In some embodiments, the body member 22 comprises a first length portion extending nonparallel to a second length portion.

In some embodiments, the shock absorber 20 engages the tension member 12 at multiple locations. In some embodiments, the shock absorber 20 engages the tension member 12 at a first location 70, a second location 72 and a third location 74. In some embodiments, the first location 70 is oriented closest to the first anchor 50 and the third location 74 is oriented closest to the second anchor 52. In some embodiments, the second location 72 is located along a length of the tension member 12 between the first location 70 and third location 74. In some embodiments, the engagement at the second location 72 causes the tension member 12 to be laterally displaced from the axis 11 of the lifeline 10.

In some embodiments, the body member 22 comprises a tube, and the tension member 12 is fully surrounded by the tube between the first location 70 and the third location 74. In some embodiments, the body member 22 comprises a non-tubular shape and is arranged to engage the tension member 12 at the locations 70, 72, 74 in any suitable way. In some embodiments, the body member 22 can comprise loops, hooks, clamps, fasteners or any other suitable engagement mechanism, or combination thereof, to engage the body member 22 and the tension member 12 at the locations 70, 72, 74.

In some embodiments, the body member 22 comprises a first portion 24 and a second portion 26. In some embodiments, the first and second portions 24, 26 comprise ends of the body member 22.

Desirably, a distance between the first portion 24 and second portion 26 is less than the length of a path between the first portion 24 and second portion 26 as traversed along the body member 22.

In some embodiments, each portion 24, 26 contacts the tension member 12. In some embodiments, the first portion 24 of the body member 22 comprises the first location 70 of engagement between the shock absorber 20 and tension member 12.

In some embodiments, the second portion 26 of the body member 22 comprises the third location 74 of engagement between the shock absorber 20 and tension member 12.

In some embodiments, the body member 22 comprises a third portion 28, and the third portion 28 contacts the tension member 12. In some embodiments, the third portion 28 contacts the tension member 12 at a location between the first portion 24 and second portion 26 along the length of the tension member 12. In some embodiments, the third portion 20 of the body member 22 comprises the second location 72 of engagement between the shock absorber 20 and tension member 12.

In some embodiments, the first location 70 and third location 74 are each located near the ordinary axis 11 of the lifeline 10, and the second location 72 is laterally displaced from the axis 11. In some embodiments, a distance between the lifeline axis 11 and the second location 72 is substantially greater than a distance between the lifeline axis 11 and the first location 70 or the third location 74.

In some embodiments, the shock absorber 20 is constructed and arranged such that higher amounts of tension in the tension member 12 cause the body member 22 to deform under load and cause the distance between the first portion 24 and second portion 26 to increase.

In some embodiments, the body member 22 can have any suitable profile and any suitable cross-sectional shape. In some embodiments, the body member 22 comprises a tube comprising a hollow interior, and the tension member 12 extends through the hollow interior.

In some embodiments, the body member 22 forms a U-shape. In some embodiments, a longitudinal axis of the body member 22 forms a U-shape.

In some embodiments, the shock absorber 20 defines a cavity 23 and the tension member 12 extends around the cavity 23. In some embodiments, a shape of the cavity 23 will change as the body member 22 deforms in response to applied loads.

In some embodiments, the shock absorber 20 comprises a nominal condition comprising a nominal shape. In some embodiments, the shock absorber 20 will assume a deformed shape in response to a high-tension condition, for example caused by a fall event. The nominal shape is intended to encompass ordinary usage and exclude fall events. The nominal shape is intended to include smaller elastic deformations that occur when the lifeline 10 is loaded under ordinary usage that excludes high-tension conditions. In some embodiments, the shock absorber 20 assumes the deformed shape under a high-tension condition, for example caused by a fall event. In some embodiments, the deformed shape comprises a plastically deformed shape when compared to the nominal shape.

Figure 4:
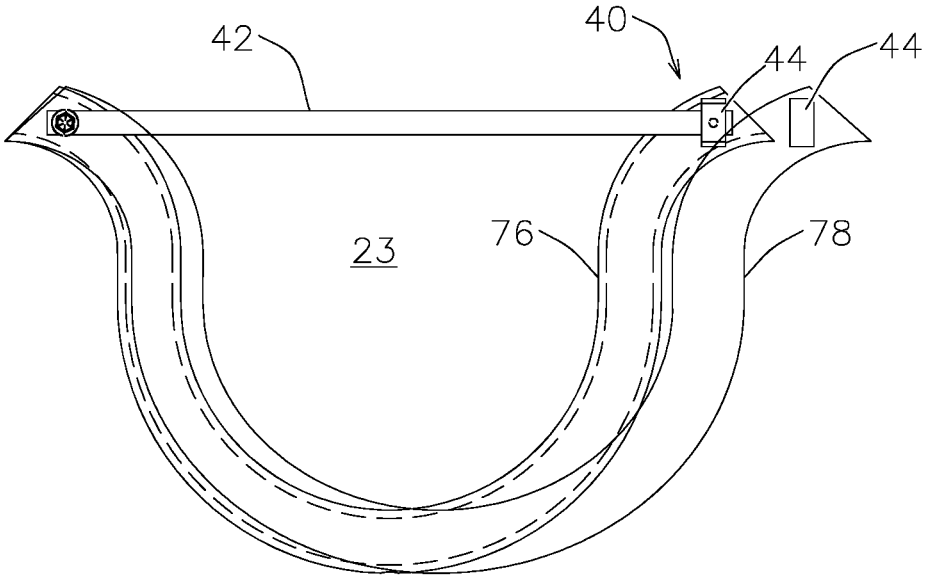
FIG. 4 shows an example of deformation of an embodiment of a shock absorber.

FIG. 4 shows an embodiment of a shock absorber 20 and illustrates examples of a nominal shape 76 and a deformed shape 78. In some embodiments, the cavity 23 changes shape as the shock absorber 20 is deformed. In some embodiments, a first dimension of the cavity 23 (e.g. width) increases as the shock absorber 20 changes from the nominal shape 76 to the deformed shape 78. In some embodiments, a second dimension of the cavity 23 (e.g. height) decreases as the shock absorber 20 changes from the nominal shape 76 to the deformed shape 78.

In some embodiments, the shock absorber 20 comprises a deformation gauge 40. In some embodiments, the deformation gauge 40 is arranged to indicate proper loading and/or overloading of tension on the tension member 12. In some embodiments, the deformation gauge 40 can indicate whether the body member 22 has experienced plastic deformation as compared to an original nominal shape, for example when the tension member 12 is not loaded. In some embodiments, the deformation gauge 40 is arranged to indicate that the shock absorber 20 should not be used due to plastic deformation from prior loading.

In some embodiments, a deformation gauge 40 comprises a rod 42 that extends between the first portion 24 and the second portion 26 of the body member 22. In some embodiments, the rod 42 is pivotably attached to the body member 22. In some embodiments, the deformation gauge 40 comprises a receiver 44 arranged to receive the rod 42 or indicate a relative position of the rod 42. In some embodiments, the receiver 44 comprises a loop of material defining a cavity, and the rod extends through the cavity. In some embodiments, the rod 44 comprises markings, such as hash markings, arranged to gauge deformation of the body member 22.

In some embodiments, the rod 42 extends to and contacts the receiver 44 when the shock absorber 20 comprises its nominal shape 76. In some embodiments, the rod 42 extends toward but does not reach the receiver 44 when the shock absorber 20 comprises its deformed shape 78.

Referring again to FIG. 2, in some embodiments, the body member 22 comprises a first length portion 30, a second length portion 32 and a third length portion 34. In some embodiments, the first length portion 30 comprises curvature. In some embodiments, curvature of the first length portion 30 comprises a first radius of curvature $r_1$. In some embodiments, the second length portion 32 comprises curvature. In some embodiments, curvature of the second length portion 32 comprises a second radius of curvature $r_2$. In some embodiments, a first inflection 36 is located between the first length portion 30 and the second length portion 32. In some embodiments, the third length portion 34 comprises curvature. In some embodiments, curvature of the third length portion 34 comprises a third radius of curvature $r_3$. In some embodiments, a second inflection 38 is located between the second length portion 32 and the third length portion 34.

In some embodiments, the second radius of curvature $r_2$ is greater than the first radius of curvature $r_1$ or the third radius of curvature $r_3$. In some embodiments, first radius of curvature $r_1$ is equal to the third radius of curvature $r_3$.

Figure 5:
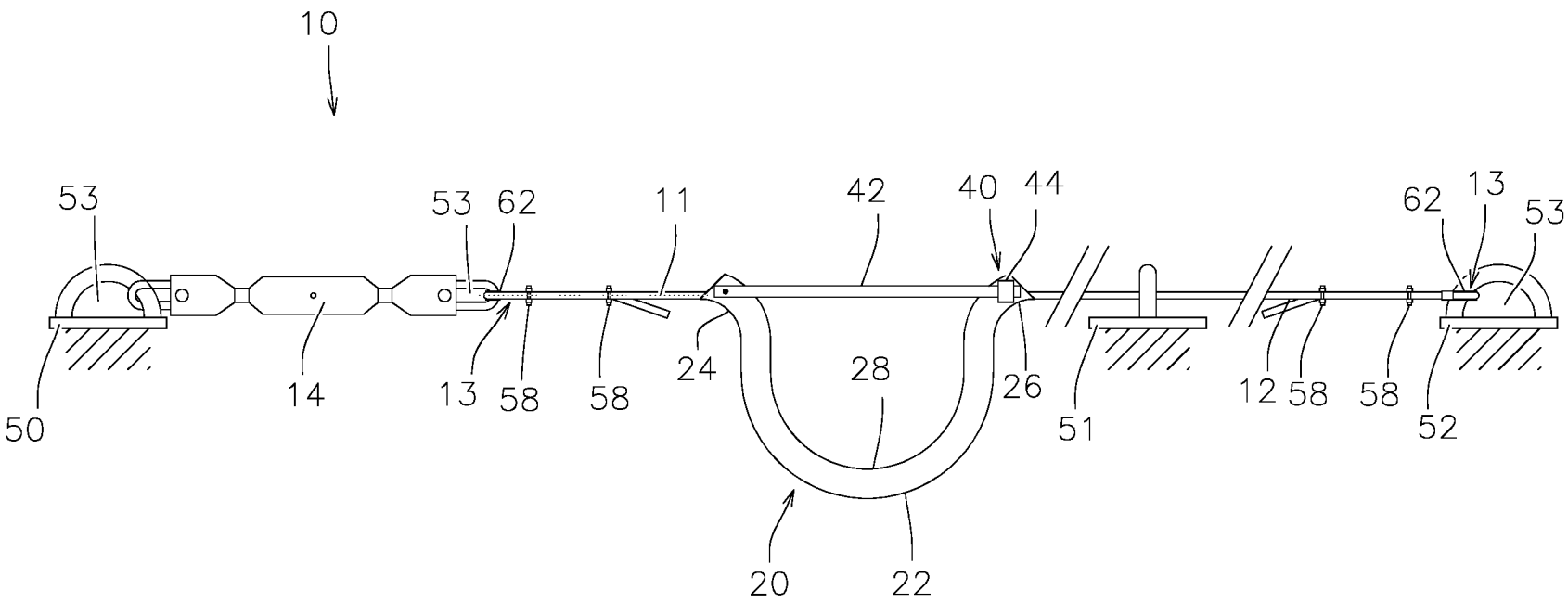
FIG. 5 shows another embodiment of a lifeline.
Figure 6:
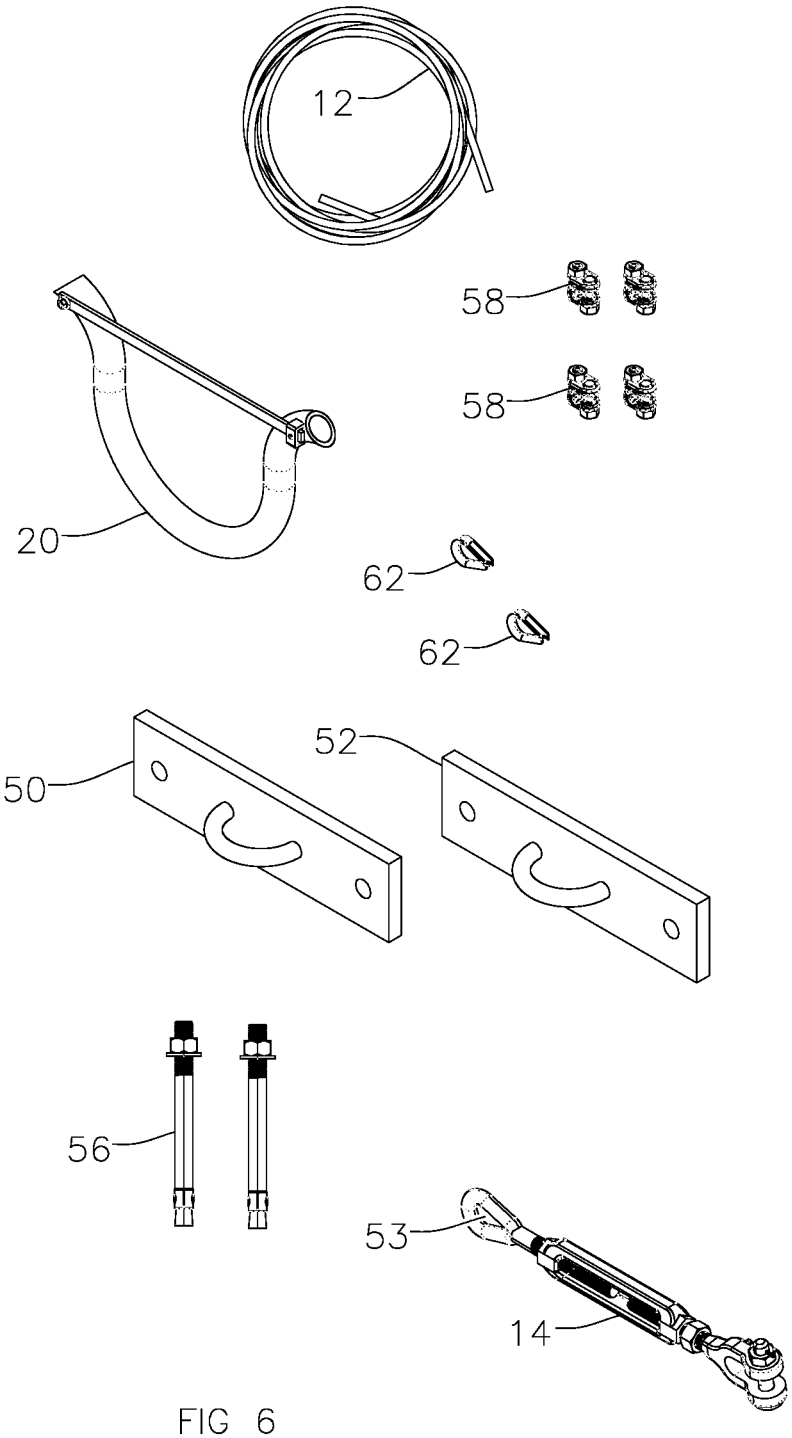
FIG. 6 shows embodiments of components of the lifeline shown in FIG. 5.

FIG. 5 shows another embodiment of a lifeline 10. FIG. 6 shows components of an embodiment of a lifeline 10.

In some embodiments, a first anchor 50 and a second anchor 52 are attached to a supporting structure, such as a building. The anchors 50, 52 can be attached using any suitable method, such as fasteners 56, welding, etc. In some embodiments, the supporting structure comprises one or more intermediate anchors 51 located between the first anchor 50 and the second anchor 52.

In some embodiments, the tension member 12 engages the first anchor 50. In some embodiments, a tensioning device 14 engages the first anchor 50 and the tension member 12 engages the tensioning device 14. As shown in FIGS. 5 and 6, the tensioning device 14 comprises a turnbuckle.

In some embodiments, the tension member 12 is attached to the tensioning device 14, or alternatively the first anchor 50, by extending through a loop 53 and folding back on itself to form an end loop 13. In some embodiments, a thimble 62 is used to guide the tension member and form the end loop 13. In some embodiments, clips 58 are used to secure the tension member 12 to itself. In some embodiments, a clip 58 comprises a wire rope clip.

In some embodiments, the tension member 12 extends toward the shock absorber 20 along the axis 11 of the lifeline 10. The tension member 12 follows a non-linear path as it traverses the shock absorber 20, then extends away from the shock absorber 20 along the axis 11 of the lifeline 10.

In some embodiments, the tension member 12 extends through any suitable number of intermediate anchors 51 along its length.

In some embodiments, the tension member 12 forms another end loop 13 at its second end. The second end loop 13 can also comprise a thimble 62, and the second end loop 13 can be formed by folding the tension member 12 back upon itself and using one or more clips 58. In some embodiments, the second end loop 13 is arranged to engage the second anchor 52.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A lifeline comprising:

a wire rope;

a shock absorber comprising a tubular body defining a lumen therethrough, the tubular body defining a longitudinal axis comprising curvature along its length; and a deformation gauge;

the wire rope extending through the lumen of the shock absorber.

2. The lifeline of claim 1, the tubular body having a nominal condition and a deformed condition, a shape of the tubular body in the nominal condition being different from a shape of the tubular body in the deformed condition.

3. The lifeline of claim 1, the shock absorber contacting the wire rope at a first location, a second location and a third location.

4. The lifeline of claim 1, the deformation gauge comprising a rod and a receiver.

5. The lifeline of claim 4, in the nominal condition, the rod extending to the receiver, in the deformed condition, the rod not extending to the receiver.

6. The lifeline of claim 1, the tubular body extending in a U-shape.

7. The lifeline of claim 1, the longitudinal axis of the tubular body comprising a U-shape.

8. A lifeline comprising:

a wire rope; and a shock absorber comprising a tubular body defining a lumen therethrough, the tubular body defining a longitudinal axis comprising curvature along its length;

the wire rope extending through the lumen of the shock absorber;

the longitudinal axis of the tubular body comprising an inflection.

9. The lifeline of claim 8, the inflection comprising a first inflection, the longitudinal axis comprising a second inflection.

10. The lifeline of claim 8, comprising a deformation gauge.

11. The lifeline of claim 8, the wire rope contacting the tubular body at a first location, a second location and a third location.

12. The lifeline of claim 8, the wire rope comprising an inelastic material.

13. A lifeline comprising:

a tension member; and a shock absorber, the shock absorber comprising a non-linear body member arranged to engage the tension member at multiple locations including a first location, a second location and a third location, the second location oriented along a length of the tension member between the first location and the third location;

wherein the second location is offset from a reference line that intersects the first location and the third location.

14. The lifeline of claim 13, wherein the shock absorber comprises a tube.

15. The lifeline of claim 14, wherein the tension member extends through the tube.

16. The lifeline of claim 13, wherein the body member comprises curvature.

17. The lifeline of claim 13, wherein the body member comprises a first length portion and a second length portion extending nonparallel to one another.

18. The lifeline of claim 13, comprising a deformation gauge.

19. The lifeline of claim 18, the deformation gauge comprising a rod.

20. The lifeline of claim 19, the rod extending between a first end and a second end of the body member.

* * * * *